United States Patent [19]

Hillman, II

[11] 4,111,637

[45] Sep. 5, 1978

[54] CONTROL SYSTEM FOR PLURALITY OF GAS SUPPLIES

[75] Inventor: William S. Hillman, II, Bountiful, Utah

[73] Assignee: Phillips Petroleum Company, Bartlesville, Okla.

[21] Appl. No.: 776,347

[22] Filed: Mar. 10, 1977

[51] Int. Cl.[2] ..... F23N 1/00

[52] U.S. Cl. ..... 431/12; 431/90; 137/7; 137/113; 137/114

[58] Field of Search ..... 431/89, 90, 2, 12; 137/112, 113, 114, 7

[56] References Cited

U.S. PATENT DOCUMENTS

| | | | |
|---|---|---|---|
| 2,418,388 | 4/1947 | Ziebolz | 137/114 |
| 3,159,345 | 12/1964 | Osburn et al. | 431/90 |
| 3,322,136 | 5/1967 | Matta | 137/118 |
| 3,552,871 | 1/1971 | Remke | 415/1 |
| 3,721,253 | 3/1973 | Remke | 137/3 |
| 3,905,394 | 9/1975 | Jerde | 431/89 |

*Primary Examiner*—Carroll B. Dority, Jr.

[57] ABSTRACT

At least two gas streams are passed into a surge vessel. The flow rate of a first one of the gas streams is manipulated responsive to either the deviations of the pressure in the surge vessel from a first pressure value or the deviations of the flow rate from a set value, depending on which would provide the larger flow rate. The flow rate of a second stream is manipulated responsive to deviations of the pressure in the surge vessel from a second pressure value which is higher than the first pressure value. The system is particularly applicable to the selective use of in-plant produced fuel gas, natural gas and liquefied petroleum gas to supply fuel gas demands in a plant, with the natural gas stream and the propane stream being the first and second streams, respectively.

20 Claims, 1 Drawing Figure

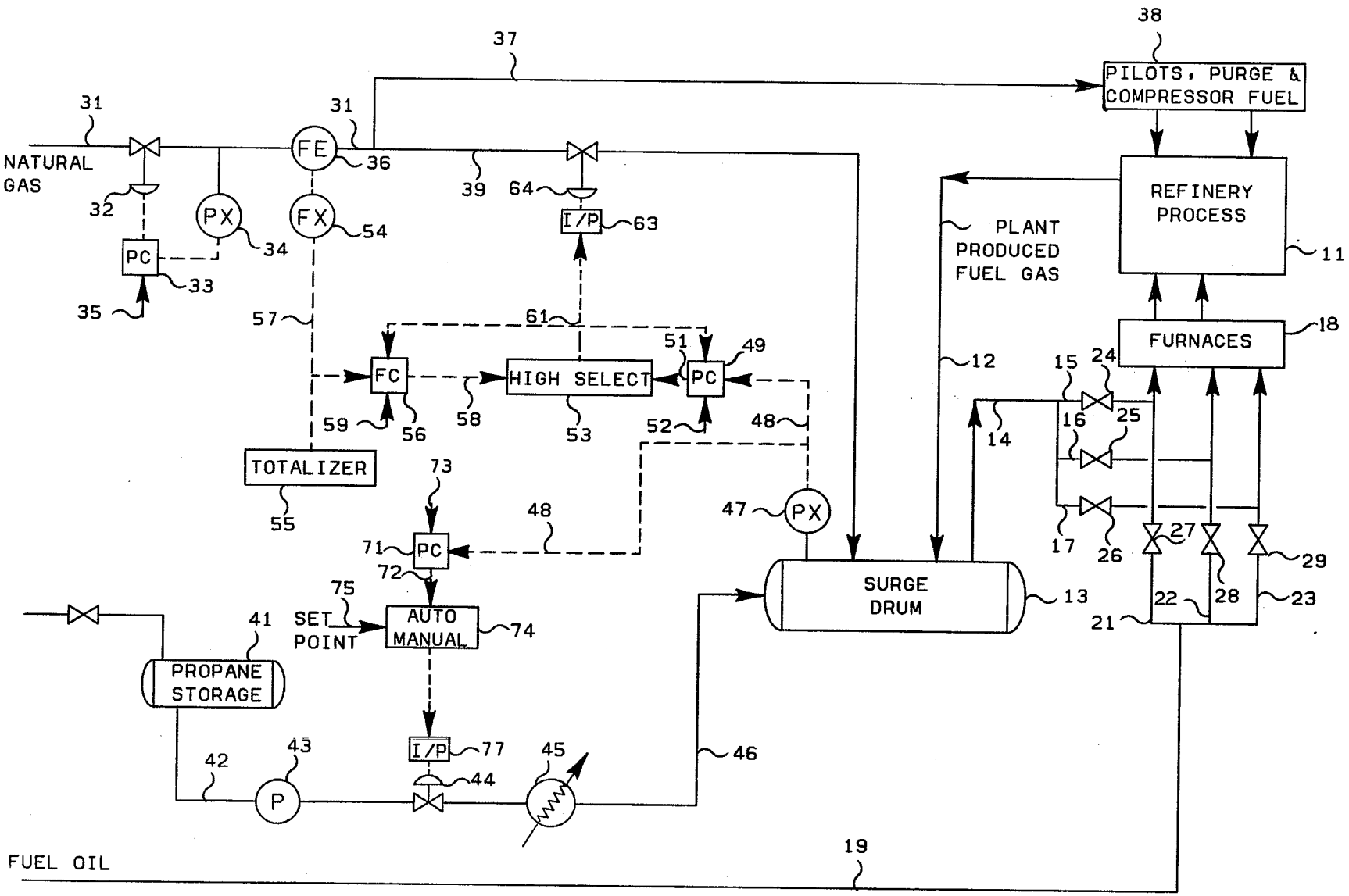
PILOTS, PURGE & COMPRESSOR FUEL
REFINERY PROCESS
FURNACES
PLANT PRODUCED FUEL GAS
SURGE DRUM
HIGH SELECT
TOTALIZER
AUTO MANUAL
SET POINT
PROPANE STORAGE
NATURAL GAS
FUEL OIL
FE
FX
PX
PC
FC
I/P
P

CONTROL SYSTEM FOR PLURALITY OF GAS SUPPLIES

This invention relates to method and apparatus for controlling the combination of at least two separate gas streams. In a specific aspect the invention relates to the control of a natural gas stream and a liquefied petroleum gas stream to selectively supplement an in-plant fuel gas stream to supply the fuel gas needs in the plant.

Shortages in purchased natural gas, new government regulations, and changes in fuel costs have forced drastic changes in the pattern of fuel use at many refineries and petrochemical plants. In the past, except for short periods of curtailment during the coldest winter months, purchased natural gas was available in unlimited amount for use as refinery fuel; fuel oil was burned primarily as a means of disposing of surplus stock; and the substitution of liquefied petroleum gas for fuel gas did not entail much of an economic penalty. Now, natural gas use is restricted much of the time, fuel oil demand and price has increased greatly; and not only has liquefied petroleum gas increased in price, but also the amount that can be burned is frequently limited by government regulation.

Natural gas is the preferred fuel for several reasons. It is, of course, the cleanest of all refinery fuels. It does not plug small piping and burner tips with dirt or sulfur. Natural gas contains little moisture to freeze and plug lines in freezing weather. Natural gas is particularly advantageous for use as compressor engine fuel, pilot light fuel, and purge gas throughout a refinery because of cleanliness and consistent heating value.

Natural gas, except for plant produced fuel gas streams, has been the cheapest fuel available. However, shortages of natural gas and government regulations force many suppliers to limit industrial use of natural gas most of the year. As natural gas is restricted, alternate fuels are used in increased quantities. Plant-produced fuel gas is generally a mixture of ethane, methane and hydrogen collected from the operating units such as catalytic cracking. In general the plant-produced fuel gas will supply less than 50% of the fuel needs of a refinery. The plant-produced fuel gas is available on a variable flow rate basis due to operating characteristics of the refinery and is generally employed as a fuel gas to the full extent available.

In many installations revisions are being made to increase fuel oil burning capacity enough that the entire heating requirement for process heaters and boilers can be supplied by plant-produced fuel gas and fuel oil. However, high priority gas uses such as compressor fuel, pilot lights, laboratory and instrument purges, will generally still require purchased natural gas or propane.

The use of liquefied petroleum gas, e.g. propane or butane, or mixtures thereof, has greatly increased in the last 6 years since natural gas restrictions began. Propane can be and is being used for compressor fuel, pilot gas, purge gas and supplemental refinery fuel gas during natural gas restrictions. Propane can be substituted for natural gas for furnace firing initially since this change can be made more quickly than installing oil burners. Fuel oil burning can then be increased as time permits the operators to change furnace burners to oil.

The economics of using these alternate fuels has become an important consideration in the selection of any control scheme to optimize refinery fuel burning. At the present time the preferred fuels listed in order of increasing cost are plant-produced fuel gas, purchased natural gas, fuel oil and propane. For lowest fuel cost, all plant-produced fuel gas should be burned and natural gas use maximized so long as limits are not exceeded which would incur a penalty. Next, fuel oil burning should be maximized when natural gas is restricted. Propane fuel use should be limited to periods during natural gas restriction and only used for two purposes. One is as a temporary fuel when natural gas is first curtailed to allow time to switch process heaters from fuel gas to fuel oil firing. The second is for high priority gas uses which require a clean gas such as for compressor engine fuel, pilot lights, and instrument purge gas.

The use of a simple pressure control system admitting natural gas as necessary to maintain set pressure on the fuel gas surge and mixing drum (vessel) would not be adequate to maximize natural gas volume or regulate natural gas flow when the use of natural gas is restricted. Since the volume of plant-produced fuel gas is unregulated and subject to change with changes in operating variables, such a system is incapable of providing control of purchased natural gas flow rate. One way of trying to meet natural gas restrictions would be to adjustably increase fuel oil burning or propane burning to decrease the flow of natural gas to approximately the flow rate desired. The flow could be set by putting the flow rate of purchased natural gas on manual control and the flow rate of propane on pressure control, but this would not provide any measure of safety for any disruption of propane supply. Such a disruption could cause loss of fuel gas pressure and severe upset on operating units.

Accordingly, it is an object of the present invention to provide a new control system which (1) controls refinery fuel gas pressure using natural gas, (2) accurately limits the use of natural gas during restrictions, and (3) reduces the amount of operator attention required. Another object of the invention is to provide a control system for utilizing propane as a supplemental fuel, but which provides for continued operation under safe conditions in the event of any difficulty with or insufficiency of the propane supply. Another object of the invention is to provide for the temporary use of propane as a supplemental fuel during the transitional period necessary to convert burners from fuel gas to fuel oil. A further object of the invention is to provide a control system which permits natural gas to be employed for high priority uses while substituting a supplemental gas for low priority uses during periods of insufficient availability of natural gas to meet the demands therefor. Other objects, aspects and advantages of the invention will be apparent from a study of the specification, the drawing and the appended claims to the invention.

The single FIGURE is a diagrammatic representation of a refinery incorporating the present invention. A plant-produced fuel gas stream is withdrawn from the refinery process 11 and passed by conduit means 12 into fuel gas surge vessel 13. The flow rate of the plant-produced fuel gas stream varies according to the operating characteristics of refinery process 11. Fuel gas is withdrawn from surge vessel 13 by way of conduit means 14 and selectively passed through conduit means 15, 16 and/or 17 to a plurality of furnaces 18 associated with refinery process 11. The furnaces 18 are adaptable to utilize either fuel gas or fuel oil. Fuel oil can be passed through conduit means 19 and one or more of conduit means 21, 22 and 23 to the furnaces which have been converted to oil firing. Conduit means 15, 16, 17, 21, 22 and 23 are provided with suitable valve means 24–29, respectively, to permit the selection of fuel gas or fuel oil for each individual furnace.

A purchased natural gas stream is available through conduit means 31. A valve means 32 comprises a valve element operatively positioned in conduit means 31 and a valve positioner. The position of the valve element is manipulated by the valve positioner in response to the control signal produced by pressure controller 33. This control signal is generated by controller 33 responsive to the difference between the desired pressure in conduit means 31 immediately downstream of valve means 32, as represented by pressure setpoint signal 35, and the actual pressure in conduit means 31 downstream of valve means 32, as represented by the measurement signal produced by pressure sensor 34. The total flow rate of natural gas through conduit means 31 is measured by turbine flow meter 36. A portion of the natural gas is withdrawn and passed by way of conduit means 37 to devices employing natural gas on a high priority basis, e.g. pilots, purge and compressors. The remainder of the natural gas is passed through conduit means 39 into surge vessel 13.

Liquid propane is stored in propane storage vessel 41 for use as a supplemental fuel. When required, liquid propane is withdrawn from vessel 41 and passed by way of conduit means 42, pump 43 and valve means 44 to vaporizer 45. The vaporized propane is then passed through conduit means 46 into surge vessel 13.

A pressure sensor-transmitter 47 is operatively positioned to measure the gas pressure in surge vessel 13 and to establish a measurement signal 48 representative thereof. The measurement signal 48 is applied to the measurement input of pressure controller 49. A control signal 51 is produced by controller 49 responsive to the difference between a setpoint pressure signal 52 and measurement signal 48. The control signal 51 is applied to a first input of high select logic device 53.

Flow transmitter 54 is associated with flow sensor 36 and transmits to a totalizer 55 and the measurement input of a flow controller 56 a measurement signal 57 representative of the total flow rate of natural gas through conduit means 31. The totalizer 55 integrates the flow signal to show the total amount of natural gas utilized in the current time period, e.g. the current month. Flow controller 56 produces a control signal 58 which is responsive to the difference between the actual flow rate of natural gas, as represented by measurement signal 57, and the desired or set flow rate of natural gas, as represented by flow setpoint signal 59. Signal 59 can be set in accordance with the prevailing regulations, e.g. the flow rate corresponding to the maximum natural gas consumption for the current time period under normal operating conditions, or at a nominal low value if there is no current restriction on the amount of natural gas consumed. The control signal 58 is applied to a second input of high select logic device 53. The circuitry of logic device 53 produces an output signal 61 which corresponds to the one of signals 51 and 58 having the value which would cause the valve element of valve means 64 to be opened to the greater degree. In the illustrated embodiment, this is the control signal having the higher value. Signal 61 is applied to the antireset-windup signal input of each of flow controller 56 and pressure controller 49 to prevent the controller which is currently producing the lower control signal from reaching full scale output due to the well known integrating action of two or three mode controllers.

The signal 61 is also applied to current-to-pressure transducer 63 located in the immediate vicinity of pneumatically operated valve means 64. The valve element of valve means 64 is operatively positioned in conduit means 39 and the degree of opening of the valve element is increased with an increase in the magnitude of signal 61.

The pressure measurement signal 48 is also transmitted to the measurement input of pressure controller 71. The control signal 72 produced by controller 71 is responsive to the difference between pressure measurement signal 48 and pressure setpoint signal 73. The control signal 72 is applied to the automatic input of auto-manual selector 74. An output signal representing either automatic control signal 72 or manual input signal 75 is applied through current-to-pressure transducer 77 to the valve positioner of pneumatically-operated valve means 44. Thus the valve element of valve means 44 is manipulated responsive to the automatic control signal 72 or manual control signal 75.

The control system has four modes of operation. The first mode is under the condition of no current restriction on natural gas consumption or a restriction which is high enough that it exceeds maximum actual demand and thus does not actually limit the use of natural gas in the refinery. In this mode propane pump 43 is off, auto-manual selector 74 is adjusted to pass a manual setpoint signal 75 to valve means 44 which maintains the valve means 44 closed, and the flow rate setpoint signal 59 is manually adjusted to a nominal value so that pressure control signal 51 will always be greater than flow control signal 58. Thus as the flow rate of the plant-produced fuel gas varies according to plant operating conditions, the flow rate of natural gas is controlled by valve means 64 responsive to the pressure in the surge vessel 13, providing whatever flow of natural gas is needed to meet the current demand represented by the pressure in surge vessel 13.

The second and third modes of operation occur when the plant is notified of a restriction on the consumption of natural gas which could interfere with the normal supply of fuel gas in surge vessel 13. An operator manually adjusts flow setpoint 59 to the restricted value of natural gas consumption. The operator actuates propane pump 43 and then gradually increases the manual setpoint signal 75 and thereby the flow rate of vaporized propane into vessel 13 until the gas pressure in surge vessel 13 reaches a value slightly higher than the pressure value represented by pressure setpoint 52. The operator then manually adjusts, if necessary, the pressure setpoint 73 to this higher value of pressure in surge vessel 13 and switches auto-manual selector 74 to its automatic position to pass the control signal 72 from pressure controller 71 to valve means 44. As pressure controller 71 is now maintaining the pressure in surge vessel 13 at a higher value than the setpoint 52 on pressure controller 49, the pressure control signal 51 decreases until it becomes smaller than flow control signal 58. At that point the output 61 of high select logic device 53 changes from being representative of pressure control signal 51 to being representative of flow control signal 58. After the transition is completed, the control system is in the second mode of operation and the plant-produced fuel gas continues to pass to surge vessel 13 at the available rate, natural gas is passed to surge vessel 13 at the maximum rate permitted by flow setpoint 59, and propane is passed to surge vessel 13 as necessary to maintain the pressure therein corresponding to setpoint 73. If the flow rate of propane is expected to be significantly high for a period of several days, the operators then begin the conversion of individual furnaces 18 from fuel gas to fuel oil. As each individual furnace is shut off from the fuel gas surge vessel 13, the demand for fuel gas decreases. Enough of the furnaces are converted to fuel oil to reduce the propane consumption to a nominal or economic rate, and fuel oil is then passed through conduit means 19 to these converted furnaces. If the projected fuel demands for several days decrease or the natural gas consumption limitation is relaxed (increased), individual furnaces are reconverted from fuel oil to fuel gas and are then supplied from surge vessel 13.

In the third mode of operation, pump 43 is actuated, valve means 44 is being manipulated responsive to the automatic control signal 72, but the natural gas available, as dictated by flow setpoint 59, exceeds the deficiencies of plant gas from conduit means 12. The pressure in surge vessel 13 will rise above the value represented by pressure setpoint 73, thereby causing the valve element of valve means 44 to move to the fully closed position, stopping the consumption of propane. With excess natural gas, the valve element of valve means 64 will be fully opened and the pressure in surge vessel 13 will continue to rise until the difference between the pressure measured by pressure sensor 34 and the pressure in surge vessel 13 is just sufficient to maintain the actual flow of natural gas required. If this condition of excess natural gas is expected to continue for several days, auto-manual selector 74 can be changed to manual control and the setpoint 75 manually decreased to a value below setpoint 52, and the pump 43 can be deactuated. In other words, with continuous excess natural gas, the flow rate of natural gas would be manipulated by pressure controller 49, while with only occasional excess natural gas the flow rate of natural gas would be manipulated by pressure controller 33. If the demand for fuel gas to supplement the plant gas increases above the restricted consumption level for natural gas, the second mode reoccurs and the flow rate of natural gas will be limited by flow controller 56 to the restricted consumption level while propane will be utilized to the extent dictated by pressure controller 71.

The fourth mode of control is effected as an emergency response to the occurrence of propane deficiency in second mode control. Such deficiency can occur if the propane supply is exhausted or pump 43 becomes inoperative or the demand for fuel gas exceeds the total of the plant gas, the restricted level of natural gas and the maximum supply rate of propane. At such occurrence the pressure in surge vessel 13 will begin to fall. When the pressure in surge vessel 13 drops below the value represented by pressure setpoint 52, the pressure control signal 51 will become greater than the flow control signal 58, thereby causing signal 51 to be passed by the high select logic 53 to valve 64. This permits the valve element of valve means 64 to be opened further to supply natural gas in excess of the restricted level during the duration of the emergency. Control reverts to the second mode automatically with the elimination of the propane deficiency. This emergency override of the restricted level of natural gas consumption permits the continued operation of the refinery. The excessive use of natural gas during the emergency can be countered by lowering the maximum natural gas consumption after the emergency is over and control is returned to one of the normal modes.

While the invention has been illustrated with pneumatic valves and electrical controllers producing voltage signals, any suitable type of control equipment and motor valves can be employed. The control equipment can be in analog or digital form and can utilize voltage signals, current signals, pneumatic signals, etc. In a specific embodiment, controllers 49 and 56 can be Foxboro model 62HA controller, controller 71 can be a Foxboro model 62H controller, high select logic device can be a Foxboro model 67HA auto selector, pressure transmitter 47 can be a Foxboro model E 11GM, flow element 36 can be a Daniel turbine meter, and flow transmitter 54 can be a Foxboro model 99V. Setpoints 35, 52 and 73 can be set at values representative of 66 psig, 50 psig and 55 psig for mode two operation. Similarly, while logic device 53 has been described as a high selector in the illustrated embodiment, a low selector could be employed where the control signals act in the reverse direction, e.g. a low signal would open valve means 64 to a greater degree than a higher signal and controllers 49 and 56 are set to produce a lower signal to effect opening of valve means 64. Also while the pressure measurement signal to propane pressure controller 71 is illustrated as being from the same transmitter as the measurement signal to pressure controller 49, separate pressure sensors can be employed if desired. The control system will also function in the absence of any plant-produced fuel gas. Although the invention has been specifically described in terms of controlling two fuel gas streams, it is applicable to the control of any two or more gas streams where one stream supplements another stream. If desired, a conduit means can be provided to selectively connect the propane supply 41 to the pilots and points of purge and compressor fuel utilization in the event that the level of natural gas available becomes insufficient for even these high priority uses. Other reasonable variations and modifications are possible within the scope of the foregoing disclosure, the drawing and the appended claims to the invention.

That which is claimed is:

1. Apparatus for meeting the demands for gas utilizing at least two separate sources of gas, comprising:

gas surge vessel means, means for withdrawing gas from said gas surge vessel means in response to the demand therefor, first supply means for supplying a first stream of gas, first conduit means for withdrawing said first stream of gas from said first supply means and for passing at least a portion of said first stream of gas to said gas surge vessel means, second supply means for supplying a second stream of gas, second conduit means for passing said second stream of gas from said second supply means to said gas surge vessel means, means for measuring the gas pressure in said gas surge vessel means and establishing a first measurement signal representative thereof, means for establishing a first pressure setpoint signal, first controller means for establishing a first control signal responsive to the difference between said first measurement signal and said first pressure setpoint signal, means for measuring the flow rate of said first stream of gas through said first conduit means and establishing a second measurement signal representative thereof, means for establishing a flow rate setpoint signal, second controller means for establishing a second control signal responsive to the difference between said second measurement signal and said flow rate setpoint signal, a first valve means operatively positioned in said first conduit means for regulating the flow rate of the portion of said first stream of gas passing to said gas surge vessel means, signal selection means having said first and second control signals applied to first and second signal inputs thereof, respectively, and adapted to produce an output signal representative of the value of the one of said first and second control signals which would cause said first valve means to open to a greater degree, means for manipulating said first valve means responsive to said output signal, means for establishing a second pressure setpoint signal representative of a higher pressure than said first pressure setpoint signal, third controller means for establishing a third control signal responsive to the difference between said second pressure setpoint signal and a signal representative of the pressure in said gas surge vessel means, a second valve means operatively positioned so as to control the flow rate of said second stream of gas through said second conduit means, and means for manipulating said second valve means responsive to said third control signal.

2. Apparatus in accordance with claim 1 further comprising third supply means for supplying a third stream of gas, and third conduit means for passing said third stream of gas from said third supply means to said gas surge vessel means.

3. Apparatus in accordance with claim 2 further comprising means for withdrawing a minor portion of said first stream of gas from said first conduit means upstream of said first valve means.

4. Apparatus in accordance with claim 3 further comprising means for measuring the pressure in said first conduit means at a point upstream of said first valve means and establishing a measurement signal representative thereof, third valve means operatively positioned in said first conduit means upstream of said first valve means and said means for measuring the flow rate, means for establishing a third pressure setpoint signal representative of a higher pressure than said second pressure setpoint signal, and fourth controller means for manipulating said third valve means responsive to the difference between said third pressure setpoint signal and said measurement signal representative of the pressure in said first conduit means upstream of said first valve means.

5. Apparatus in accordance with claim 4 wherein said first and second streams of gas are fuel gas streams; further comprising a plurality of furnaces adaptable to employ fuel gas or fuel oil; means adapted to pass a portion of the fuel gas withdrawn from said gas surge vessel means to each of said furnaces on a selective basis; a source of fuel oil; means adapted to pass fuel oil from said source of fuel oil to each of said plurality of furnaces on a selective basis; whereby when the supplies of said first and third streams of gas are sufficient to meet all the demands for fuel gas, said second stream of gas provides the balance of the requirements until at least one of the furnaces utilizing fuel gas can be converted to utilize fuel oil to reduce the demands for fuel gas to a level which can be met by the supplies of said first and third streams of gas.

6. Apparatus in accordance with claim 1 further comprising means for measuring the pressure in said first conduit means at a point upstream of said first valve means and establishing a measurement signal representative thereof, third valve means operatively positioned in said first conduit means upstream of said first valve means and said means for measuring the flow rate, means for establishing a third pressure setpoint signal representative of a higher pressure than said second pressure setpoint signal, and fourth controller means for manipulating said third valve means responsive to the difference between said third pressure setpoint signal and said measurement signal representative of the pressure in said first conduit means upstream of said first valve means.

7. Apparatus in accordance with claim 1 wherein said first and second streams of gas are fuel gas streams; further comprising a plurality of furnaces adaptable to employ fuel gas or fuel oil; means adapted to pass a portion of the fuel withdrawn from said gas surge vessel means to each of said furnaces on a selective basis; a source of fuel oil; means adapted to pass fuel oil from said source of fuel oil to each of said plurality of furnaces on a selective basis; whereby when the supply of said first stream of gas is insufficient to meet all the demands for fuel gas, said second gas stream provides the balance of the requirements until at least one of the furnaces utilizing fuel gas can be converted to utilize fuel oil to reduce the demands for fuel gas to a level which can be met by the first stream of gas.

8. Apparatus in accordance with claim 1 wherein said output signal of said signal selection means is representative of the higher of said first and second control signals.

9. Apparatus in accordance with claim 1 wherein said signal representative of the pressure in said gas surge vessel is said first measurement signal.

10. A method for meeting the demands for gas utilizing at least two separate sources of gas, comprising passing at least a portion of a first stream of gas into a gas surge vessel, passing at least a portion of a second stream of gas into said surge vessel, withdrawing gas from said surge vessel in response to the demands therefor, measuring the gas pressure in said surge vessel and establishing a first measurement signal representative thereof, establishing a first pressure setpoint signal, establishing a first control signal responsive to the difference between said first measurement signal and said first pressure setpoint signal, measuring the flow rate of said first stream of gas and establishing a second measurement signal representative thereof, establishing a flow rate setpoint signal, establishing a second control signal responsive to the difference between said second measurement signal and said flow rate setpoint signal, selecting the one of said first and second control signals which corresponds to the greater demand for said first stream of gas, varying the flow rate of said first stream of gas responsive to the thus selected control signal, establishing a second pressure setpoint signal representative of a higher pressure than said first pressure setpoint signal, establishing a third control signal responsive to the difference between said second pressure setpoint signal and a signal representative of the pressure in said surge vessel, and varying the flow rate of said second stream of gas passing to said surge vessel responsive to said third control signal.

11. A method in accordance with claim 10 further comprising passing a third stream of gas to said surge vessel.

12. A method in accordance with claim 11 wherein said first stream of gas comprises natural gas, said second stream of gas comprises propane, and said third stream of gas comprises synthetic fuel gas.

13. A method in accordance with claim 12 wherein said third stream of gas is passed to said gas surge vessel at a variable rate of flow.

14. A method in accordance with claim 13 further comprising utilizing a portion of said first stream of gas for a purpose other than passage to said surge vessel.

15. A method in accordance with claim 14 further comprising measuring the pressure of said first stream of gas at a point upstream of the point at which the flow rate of the portion of said first stream of gas going to said surge vessel is varied and establishing a measurement signal representative thereof, establishing a third pressure setpoint signal representative of a higher pressure than said second pressure setpoint signal, establishing a fourth control signal responsive to the difference between said third pressure setpoint signal and said measurement signal representative of the pressure of said first stream, and varying the flow rate of the total first stream of gas responsive to said fourth control signal.

16. A method in accordance with claim 15 further comprising passing at least a portion of the gas withdrawn from said surge vessel to a plurality of furnaces which are adaptable to employ fuel gas or fuel oil, converting at least one of said furnaces to employ fuel oil when the flow rate of said second stream of gas is substantial, thereby reducing the demand for fuel gas from said surge vessel, and passing fuel oil to the at least one thus converted furnace.

17. A method in accordance with claim 16 further comprising reconverting at least one of said furnaces from fuel oil to fuel gas when said first and third streams of gas are adequate to supply the demands for fuel gas from said surge vessel, and passing fuel gas from said surge vessel to the at least one thus reconverted furnace.

18. A method in accordance with claim 11 further comprising measuring the pressure of said first stream at a point upstream of the point at which the flow rate of the portion of said first stream of gas going to said surge vessel is varied and establishing a measurement signal representative thereof, establishing a third pressure setpoint signal representative of a higher pressure than said second pressure setpoint signal, establishing a fourth control signal responsive to the difference between said third pressure setpoint signal and said measurement signal representative of the pressure of said first stream, and varying the flow rate of the total first stream of gas responsive to said fourth control signal.

19. A method in accordance with claim 15 wherein each of said first and second streams of gas is a fuel gas, and further comprising passing at least a portion of the gas withdrawn from said surge vessel to a plurality of furnaces which are adaptable to employ fuel gas or fuel oil, converting at least one of said furnaces to employ fuel oil when the flow rate of said second stream of gas is substantial, thereby reducing the demand for fuel gas from said surge vessel, and passing fuel oil to the at least one thus converted furnace.

20. A method in accordance with claim 19 further comprising reconverting at least one of said furnaces from fuel oil to fuel gas when said first and third streams of gas are adequate to supply the demands for fuel gas from said surge vessel, and passing fuel gas from said surge vessel to the at least one thus reconverted furnace.

* * * * *

UNITED STATES PATENT AND TRADEMARK OFFICE

CERTIFICATE OF CORRECTION

PATENT NO. : 4,111,637

DATED : September 5, 1978

INVENTOR(S) : William S. Hillman, II

It is certified that error appears in the above-identified patent and that said Letters Patent are hereby corrected as shown below:

Column 7, line 64, "sufficient" should read -- insufficient --.

Signed and Sealed this

*Thirteenth* Day of *January 1981*

[SEAL]

*Attest:*

SIDNEY A. DIAMOND

*Attesting Officer*

*Commissioner of Patents and Trademarks*